United States Patent [19]

Regev

[11] Patent Number: 4,934,435

[45] Date of Patent: Jun. 19, 1990

[54] SHADE CONSTRUCTION

[76] Inventor: Amos Regev, 428 Acorn Dr., Paramus, N.J. 07652

[21] Appl. No.: 286,349

[22] Filed: Dec. 19, 1988

[51] Int. Cl.[5] ..... E06B 3/94

[52] U.S. Cl. ..... 160/84.1; 160/264

[58] Field of Search ..... 160/84.1, 264, 243, 160/244, 245, 379

[56] References Cited

U.S. PATENT DOCUMENTS

| | | | |
|---|---|---|---|
| 1,752,610 | 4/1930 | McSpadden | 160/84.1 |
| 3,375,818 | 4/1968 | Luther | 160/84.1 X |
| 3,487,875 | 1/1970 | Shukat et al. | 160/84.1 |
| 3,777,800 | 12/1973 | Susoev | 160/84.1 |
| 4,069,857 | 1/1978 | Brookshire | 160/84.1 |
| 4,665,964 | 5/1987 | Zommers | 160/84.1 |
| 4,683,933 | 8/1987 | Dunbar | 160/84.1 X |
| 4,712,598 | 12/1987 | Bonacci et al. | 160/84.1 |
| 4,741,375 | 5/1988 | Milford et al. | 160/84.1 |

*Primary Examiner*—David M. Purol

*Attorney, Agent, or Firm*—Samuelson & Jacob

[57] ABSTRACT

A shade construction of the type in which a vertically hanging sheet of shade material is divided by pleats into shade panels, each of which will fold into a forwardly-directed folded configuration upon retraction of the shade, includes a rearwardly-extending loop in the shade material at each pleat, the loop having portions extending in directions parallel to the hanging sheet of shade material so as to assure that the shade material is bent sharply rearwardly at transition portions of the shade material where the panels meet the pleats such that the shade material itself will bias each panel into an aesthetically well-formed forwardly-directed folded configuration. In one embodiment, the shade includes a forwardly-extending loop at each pleat in addition to rearwardly-extending loops, such that the forwardly-extending loop establishes a pleasing aesthetic effect, while the rearwardly-extending loops assure that the shade material is bent sharply rearwardly at the transition from the panels to the pleats to bias each panel into the desired forwardly-directed folded configuration.

18 Claims, 4 Drawing Sheets

SHADE CONSTRUCTION

The present invention relates generally to window shades and pertains, more specifically, to an improvement in the construction of window shades of the type in which the material of the shade is pleated and takes the shape of aesthetically pleasing folds between the pleats as the shade is drawn upwardly from a vertically hanging extended configuration to a retracted configuration.

Among the ever-increasing variety of decorative window treatments being made available, window shades are still a popular choice. One window shade construction which has gained popularity over recent years is the type in which the shade material is pleated to establish a series of consecutive, vertically stacked panels which, upon retraction of the shade, take the shape of cascading folds to provide an aesthetically pleasing appearance when retracted. These shades frequently are referred to as "Roman" shades.

The present invention provides an improvement in the type of window shade construction described above and has several objects and advantages, some of which may be summarized as follows: facilitates the establishment of aesthetically well-formed folds upon retraction of the shade; assures positive formation of the folds with uniformity and consistency so that the aesthetic appearance of the shade is more closely controlled by design; enables the accomplishment of a wider variety of aesthetic effects; provides ease of manufacture and enables aesthetically complex designs to be manufactured more economically; enables the use of a greater variety of available materials in designs which heretofore did not lend themselves to the ready use of all such materials; promotes ease of assembly for increased economy; enables simplified installation procedures; promotes ease of operation and use; enables installation and use in a wider range of locations; provides a simplified construction which is not only economical to manufacture, but is mechanically sound and rugged enough to extend the usefulness of the shade over a longer service life.

The above objects and advantages, as well as further objects and advantages are attained by the present invention, which may be described briefly as an improvement in a shade construction of the type in which a vertically hanging sheet of shade material having a forwardly-facing obverse face and a rearwardly-facing reverse face is provided with a plurality of horizontally-extending, vertically spaced apart pleats, consecutive shade panels delineated by the pleats and extending along a plane coincident with the hanging sheet, and a draw cord associated with the pleats such that upon drawing the pleats vertically toward one-another to retract the shade material, each shade panel will fold into a forwardly-directed folded configuration, the improvement facilitating the establishment of an aesthetically well-formed forwardly-directed folded configuration in each of the shade panels upon retraction of the shade material, the improvement comprising: A rearwardly-extending loop in the shade material at each pleat, the loop extending horizontally along the pleat and including a rearwardly-looped portion having a cross-sectional configuration extending in directions generally parallel to the plane of the hanging sheet of shade material, and a pair of legs juxtaposed with one another between the rearwardly-looped portion and the reverse face of the sheet of shade material; securing means securing the juxtaposed legs together immediately adjacent the reverse face of the sheet of shade material to maintain the legs juxtaposed and the rearwardly-extending loop closed; a stiffening rod placed within the rearwardly-looped portion and extending horizontally throughout essentially the full horizontal extent of the rearwardly-looped portion; and an aperture in the juxtaposed legs of each rearwardly-extending loop, each aperture being located between the reverse face of the sheet of shade material and the stiffening rod, with corresponding apertures aligned vertically behind the shade material; the draw cord passing through the aligned apertures.

The invention will be understood more fully, while still further objects and advantages will become apparent, in the following detailed description of preferred embodiments of the invention illustrated in the accompanying drawing, in which.

Figure 1:
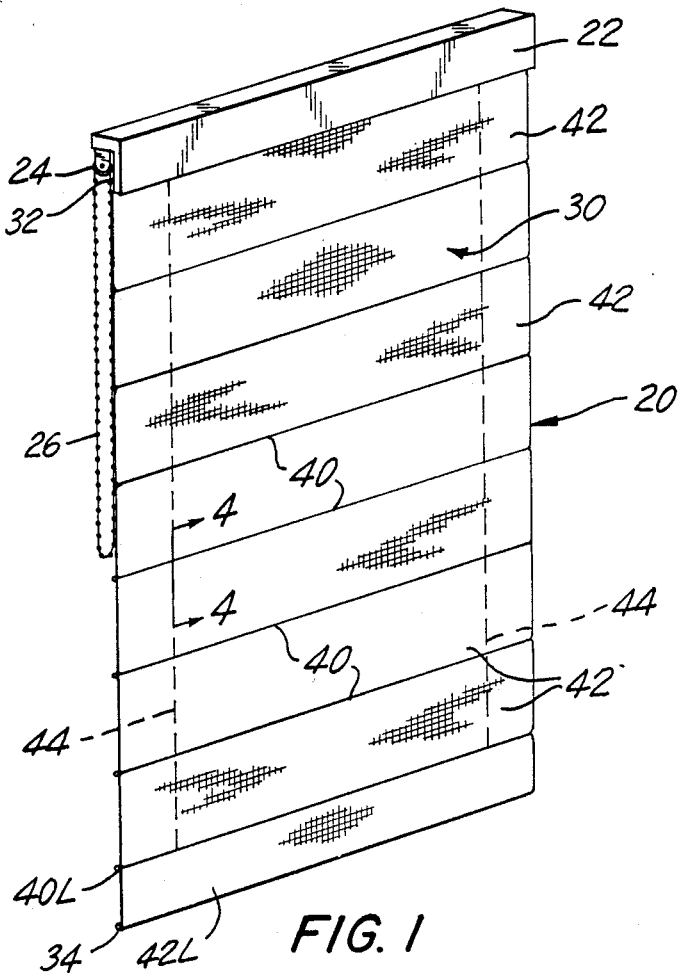
FIG. 1 is a pictorial perspective view of a window shade constructed in accordance with the invention.

Referring now to the drawing, and especially to FIG. 1 thereof, a shade constructed in accordance with the invention is illustrated at 20 and is seen to have a generally horizontally-extending headrail 22 upon which a roller 24 is mounted for rotation relative to the headrail 22 in response to selective manual actuation of an actuator in the form of a beaded chain 26, all in a now-conventional manner. A sheet 30 of shade material is affixed to the headrail 22 at 32 adjacent the top of the sheet 30 and hangs from the headrail 22, the sheet 30 being weighted slightly adjacent the bottom thereof, at 34, so that the sheet 30 remains extended vertically, preferably over a window 35 (see FIG. 2).

Figure 3:
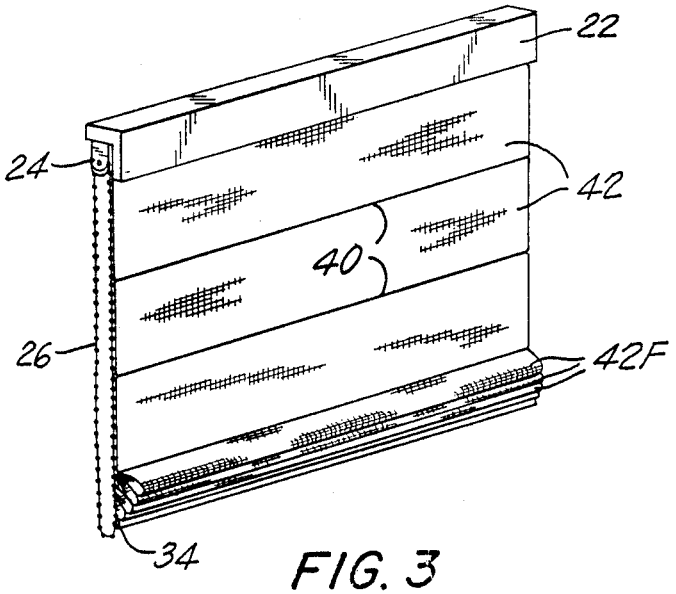
FIG. 3 is a view similar to FIG. 1, but with the window shade partially, retracted.
Figure 2:
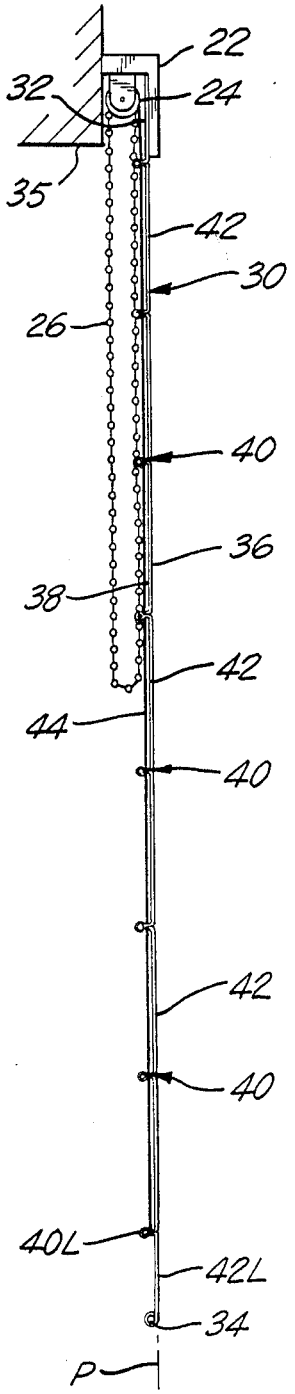
FIG. 2 is a side elevational view of the window shade of FIG. 1.

Turning now to FIG. 2, as well as to FIG. 1, sheet 30 has a forwardly-facing obverse face 36 and a rearwardly-facing reverse face 38. A plurality of pleats 40 in the sheet 30 extend horizontally and are spaced apart vertically to delineate a series of consecutive panels 42 coincident with plane P of hanging sheet 30. A pair of draw cords 44 are associated with the pleats 40 and extend vertically downwardly from the roller 24 to the lowermost pleat 40L, which lowermost pleat 40L extends horizontally between the lowermost panel 42L and the next consecutive panel 42 immediately above the lowermost pleat 40L. Draw cords 44 are affixed to the roller 24 and are associated with the pleats 40 such that upon actuating the beaded chain 26 to rotate the roller 24 and wind the draw cords 44 onto the roller 24, the shade 20 will be raised, as seen in FIG. 3. As the shade 20 is raised, each panel 42 will fold into a forwardly-directed folded configuration, as seen at 42F, thereby providing an appealing aesthetic effect in the retracted shade 20. Shades of the type in which panels are each folded into a forwardly-directed configuration upon retraction of the shade are commonly known as "Roman" shades.

Figure 4:
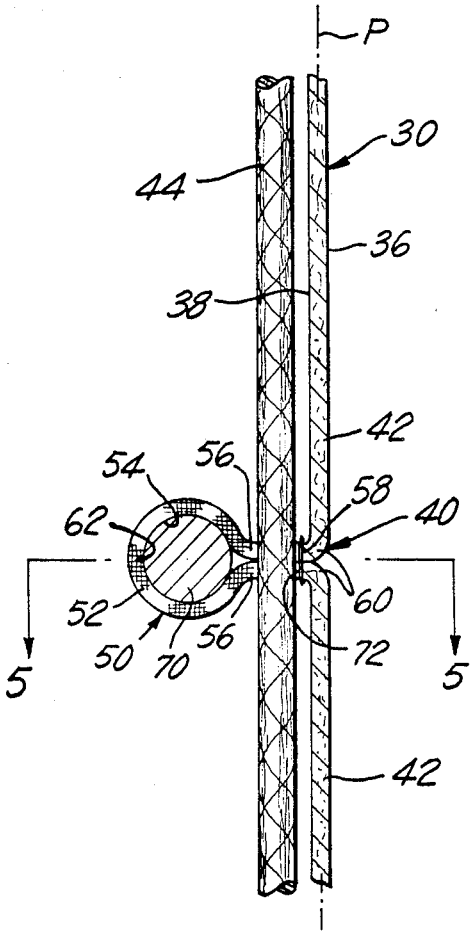
FIG. 4 is an enlarged, fragmentary cross-sectional view taken along line 4—4 of FIG. 1.
Figure 5:
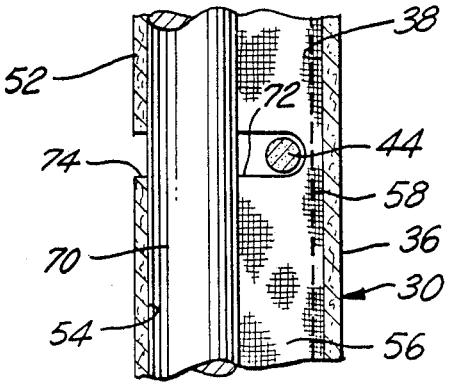
FIG. 5 is a cross-sectional view taken along line 5—5 of FIG. 4.

The present invention provides an improvement in which the construction of the pleats 40 facilitates the establishment of an aesthetically well-formed forwardly-directed folded configuration in each of the shade panels 42. Thus, referring now to FIGS. 4 and 5, the sheet 30 of shade material has a rearwardly-extending loop 50 at each pleat 40, each loop 50 extending horizontally along the corresponding pleat 40 and including a rearwardly-looped portion 52 having a cross-sectional configuration 54 and a pair of legs 56 juxtaposed with one-another between the rearwardly-looped portion 52 and the reverse face 38 of the sheet 30. Securing means, preferably in the form of a sewn seam 58, secures together the juxtaposed legs 56 immediately adjacent the reverse face 38 of the sheet 30 to maintain the legs 56 juxtaposed and the rearwardly-looped portion 52 closed. The cross-sectional configuration 54 extends the looped portion 52 in vertical directions, that is, in directions generally parallel to the plane P of hanging sheet 30, so that the combination of the securement provided by the sewn seam 58 closely adjacent the reverse face 38 and the cross-sectional configuration 54 of the rearwardly-looped portion 52 assures that the material of sheet 30 will be bent sharply rearwardly at transition portions 60 of the material of sheet 30 where each panel 42 meets a corresponding pleat 40, thereby utilizing the elasticity of the material of the sheet 30 to tend to bias the panels 42 of the sheet 30 into the desired, aesthetically pleasing forwardly-directed folded configuration 42F. The aforesaid construction provides a marked improvement, especially where the material of the sheet 30 has a degree of renitence, or stiffness, such as is found in certain synthetic materials which have desirable shading characteristics, but heretofore have been found less suited to shades of the type described herein due to difficulties encountered in controlling the configuration assumed by the material when subjected to the manipulations required to form the forwardly-directed folded configuration 42F in each panel 42. One such material which exhibits superior performance as a shade material, but which is somewhat stiff and difficult to control, is a vinyl coated fiberglass. While that material has been available commercially for window coverings, and has proved to posses superior qualities by way of filtering light and cutting heat and glare, the mechanical properties of the material have limited the use of the material to window treatments other than "Roman" shades. The construction of the present invention enables better control of the material insofar as predictability of the formation of aesthetically correct forwardly-directed folds, and has enabled the use of a superior material in a desirable form of window shade. In order to facilitate further the formation and maintenance of the desired cross-sectional configuration 54 in rearwardly-looped portion 52, the material of sheet 30 is scored, as by a notch 62 located in the rearwardmost part of portion 52, prior to bending the material of the sheet 30 into the looped configuration of rearwardly-looped portion 52. The preferred configuration for the cross-sectional configuration 54 is generally circular, as illustrated, since the generally circular configuration is simple in construction and is itself aesthetically pleasing.

In order to maintain the rearwardly-looped portion 52 in the desired cross-sectional configuration 54, a stiffening rod 70 is placed in the rearwardly-looped portion 52 and extends along the length of the rearwardly-looped portion 52 across the width of the sheet 30 of shade 20. Stiffening rod 70 may be constructed of metal, wood or of a suitably rigid synthetic resin material and serves to spread the rearwardly-looped portion 52 in vertical directions, that is, in directions parallel to the plane P of sheet 30, to attain the desired effect. Stiffening rod 70 is provided with a cross-sectional configuration to conform the cross-sectional configuration 54 to the illustrated preferred generally circular configuration. Stiffening rod 70 also serves to stiffen the sheet 30 along the pleats 40 to enhance the appearance of the shade 20 both in the extended state illustrated in FIG. 1 and in the retracted state illustrated in FIG. 3.

Each rearwardly-extending loop 50 is provided with an aperture in the juxtaposed legs 56 of the loop 50 for the passage of a draw cord 44 through aligned apertures in consecutive loops 50, the apertures each being illustrated in the form of a slot 72 having an opening 74 facing rearwardly, each slot 72 extending forwardly from the opening 74 through the corresponding rearwardly-looped portion 52 and into the juxtaposed legs 56 so that the draw cord 44 is located between the stiffening rod 70 and the reverse face 38 of the sheet 30 and is captured in the slot 72 by the stiffening rod 70. Assembly of the draw cords 44 with the sheet 30 is facilitated by inserting the stiffening rods 70 into the rearwardly-looped portions 52 and then placing the draw cords 44 in the respective slots 72 to capture the draw cords 44 between the stiffening rods 70 and the reverse face 38 of sheet 30. The combination of the slots 72 and the stiffening rods 70 for capturing the draw cords 44 at the pleats 40 enables the draw cords 44 to ride against the smoother surface presented by the stiffening rods 70, rather than against the coarser surface of the shade material of sheet 30, during retraction and extension of the shade 20, thereby reducing friction and enhancing the operation of the shade 20.

Figure 6:
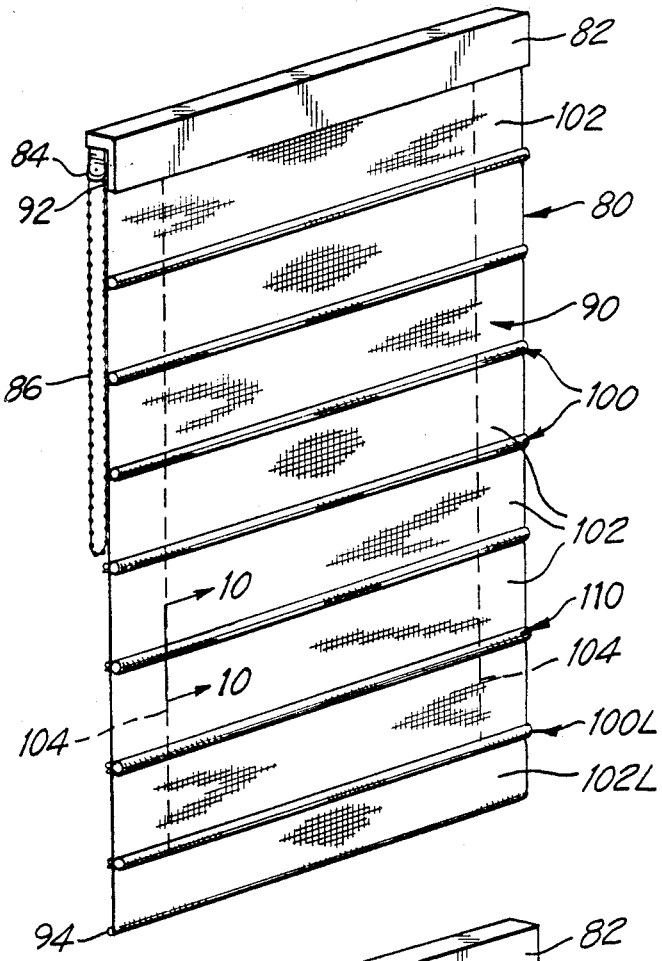
FIG. 6 is a pictorial perspective view of another window shade constructed in accordance with the invention.

Referring now to FIG. 6, another window shade constructed in accordance with the invention is illustrated at 80 and is seen to have a generally horizontally-extending headrail 82 upon which a roller 84 is mounted for rotation relative to the headrail 82 in response to selective manual actuation of an actuator in the form of a beaded chain 86, all in a manner similar to that described above in connection with shade 20. A sheet 90 of shade material is affixed to the headrail 82 at 92 adjacent the top of the sheet 90 and hangs from the headrail 82, the sheet 90 being weighted slightly adjacent the bottom thereof, at 94, so that the sheet 90 remains extended vertically, preferably over a window 95 (see FIG. 7).

Figure 8:
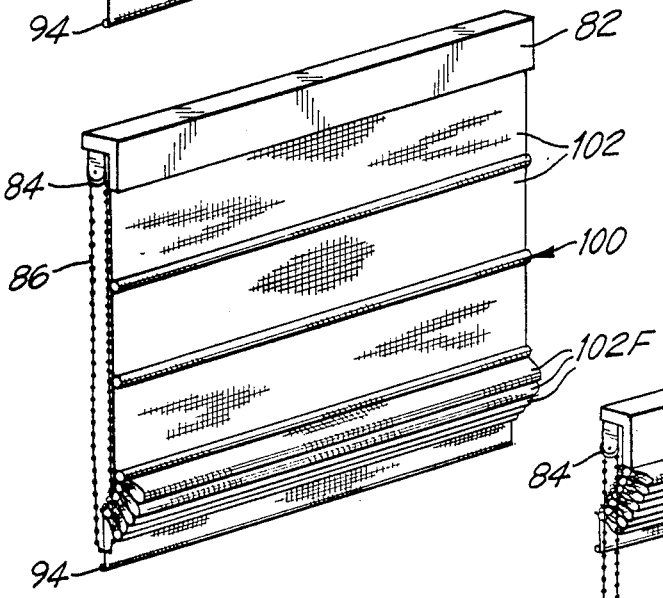
FIG. 8 is a view similar to FIG. 6, but with the window shade partially retracted.
Figure 9:
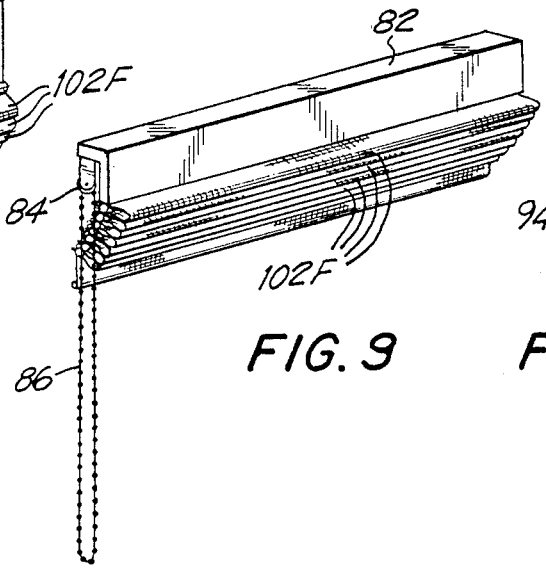
FIG. 9 is another view similar to FIG. 6, but with the window shade fully retracted.
Figure 7:
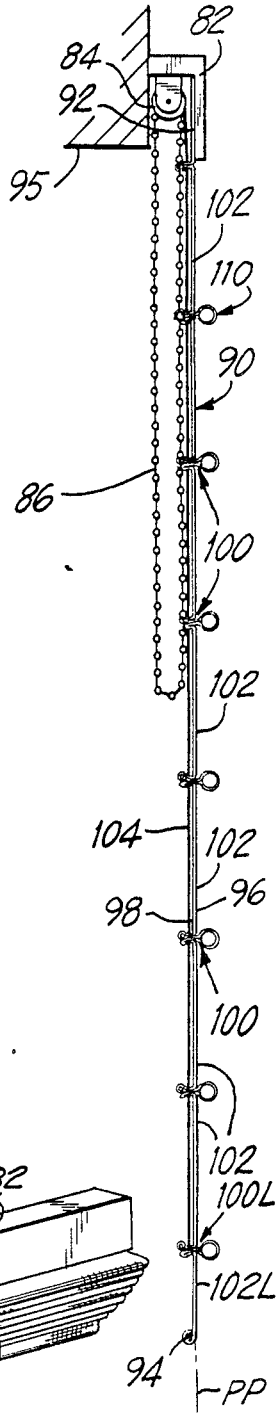
FIG. 7 is a side elevational view of the window shade of FIG. 6.

Turning now to FIG. 7, as well as to FIG. 6, sheet 90 has a forwardly-facing obverse face 96 and a rearwardly-facing reverse face 98. A plurality of pleats 100 in the sheet 90 extend horizontally and are spaced apart vertically to delineate a series of consecutive panels 102 coincident with plane PP of hanging sheet 90. A pair of draw cords 104 are associated with the pleats 100 and extend vertically downwardly from the roller 84 to the lowermost pleat 100L, which lowermost pleat 100L extends horizontally between the lowermost panel 102L and the next consecutive panel 102 immediately above the lowermost pleat 100L. Draw cords 104 are affixed to the roller 84 and are associated with the pleats 100 such that upon actuating the beaded chain 86 to rotate the roller 84 and wind the draw cords 104 onto the roller 84, the shade 80 will be raised, as seen in FIGS. 8 and 9. As the shade 80 is raised, each panel 102 will fold into a forwardly-directed folded configuration, as seen at 102F, thereby providing an appealing aesthetic effect of cascading folds in the retracted shade 80.

Figure 10:
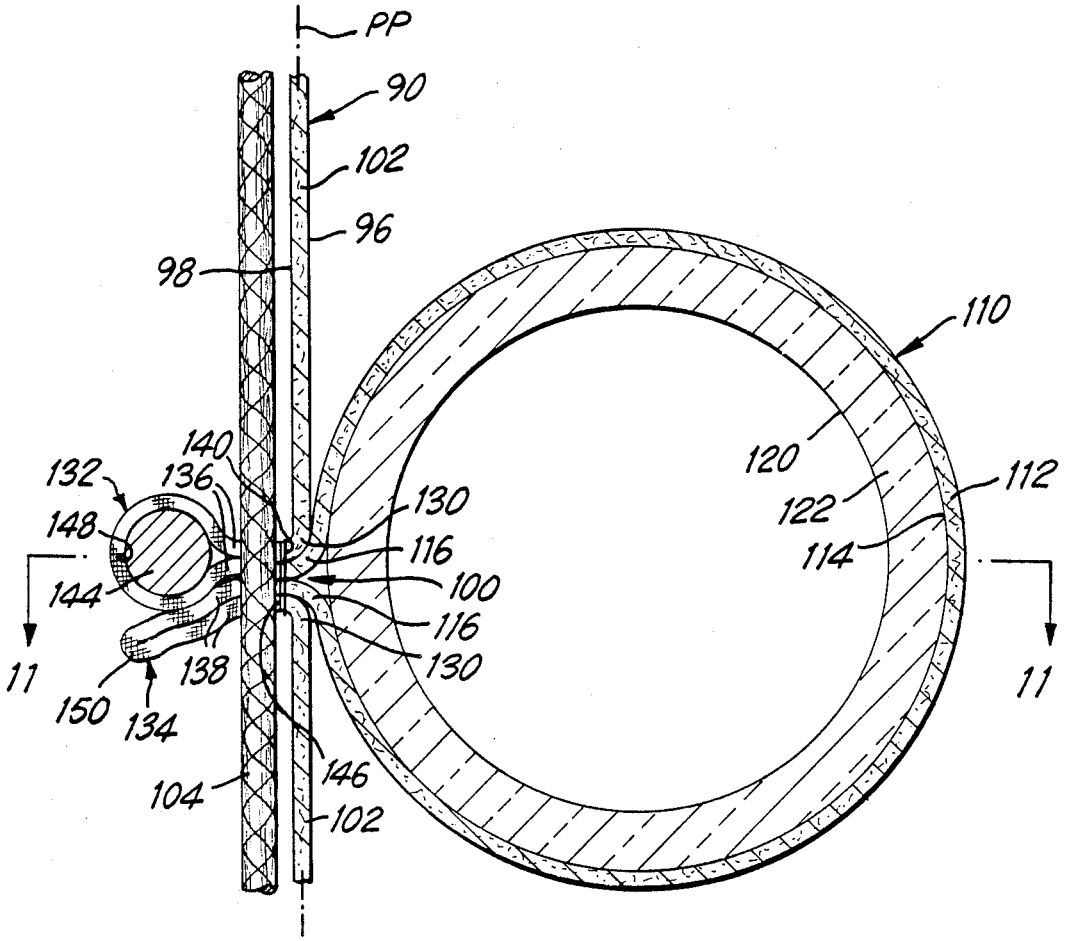
FIG. 10 is an enlarged fragmentary cross-sectional view taken along line 10—10 of FIG. 6.
Figure 11:
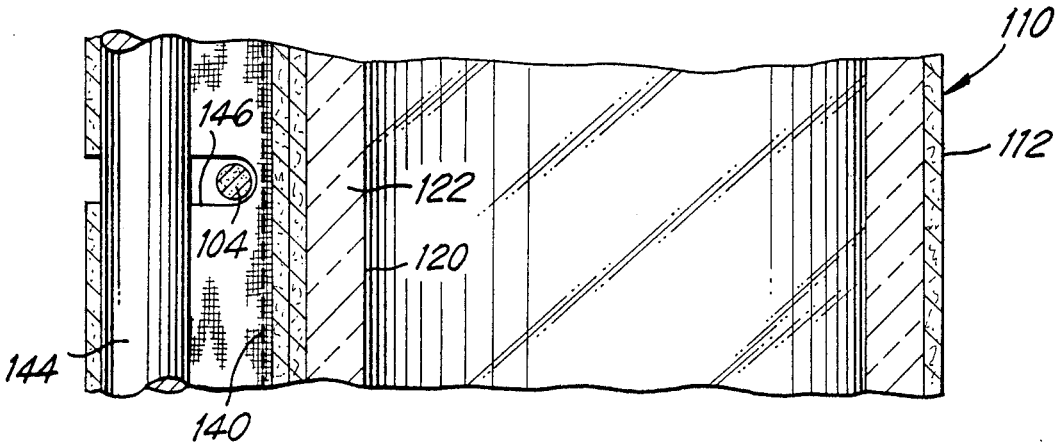
FIG. 11 is a cross-sectional view taken along line 11—11 of FIG. 10.

As best seen in FIGS. 10 and 11, the construction of pleats 100 within the sheet 90 of shade 80 includes a forwardly-extending loop 110 at each pleat 100, each forwardly-extending loop 110 extending horizontally across the width of the sheet 90 and having a forwardly-looped portion 112 with a cross-sectional configuration 114 and a pair of legs 116. A shaping member in the form of a shaping bar 120 is placed within each forwardly-extending loop 100 and provides the cross-sectional configuration 114 of forwardly-looped portions 112 with an aesthetically pleasing shape, as well as providing a reinforcement at each pleat 100, which reinforcement tends to maintain the pleats 100 straight and parallel with one-another. Cross-sectional configuration 114 extends in vertical directions relative to the panels 102 in sheet 90, that is, in directions generally parallel to plane PP of sheet 90. Where the material of sheet 90 is somewhat transparent, as is the case with some open-webbed shade materials, the shaping bar 120 preferably is constructed of a transparent material, such as an acrylic plastic, so as not to interfere with the transparent nature of the material of sheet 90. Shaping bar 120 preferably is constructed in the form of a hollow tube having a cylindrical tubular wall 122 which provides rigidity without excessive weight and establishes a generally circular cross-sectional configuration 114 of relatively large diameter in forwardly-looped portions 112. The forwardly-extending larger loops 110 provide shade 80 with an added design feature having enhanced aesthetic appeal.

In order to assure that each of the panels 102 of shade 80 is biased into the forwardly-directed folded configuration 102F, the material of sheet 90 is bent sharply rearwardly at transition portions 130 of the sheet 90 where each shade panel 102 meets a corresponding pleat 100, despite the presence of the forwardly-extending loops 110. Thus, the shade material of sheet 90 extends from a panel 102 rearwardly into a first rearwardly-extending loop 132, then forwardly from the first rearwardly-extending loop 132 into the forwardly-extending loop 110, and then rearwardly again into a second rearwardly-extending loop 134 so that each transition portion 130 is bent sharply rearward and establishes biasing forces tending to facilitate the formation of each forwardly-extending folded configuration 102F into well-formed aesthetically pleasing folds. The rearwardly-extending loops 132 and 134 are smaller than the forwardly-extending loop 110 and include respective juxtaposed pairs of legs 136 and 138, which legs 136 and 138 are secured together, as by sewn seams 140 placed closely adjacent the reverse face 98 of sheet 90. As in the earlier-described embodiment of FIGS. 1 through 5, a stiffening rod 144 is located in one of the rearwardly-extending loops of each pleat 100, as illustrated in connection with rearwardly-extending loop 132, and the stiffening rods 144 capture the draw cords 104 within slots 146 in the rearwardly-extending loops 132 and 134. Notches 148 and 150 are provided in rearwardly-extending loops 132 and 134, respectively, to assist in attaining the desired cross-sectional configuration in each loop 132 and 134. It is not necessary to insert a stiffening rod into each rearwardly-extending loop 132 and 134 since one stiffening rod 144, as shown, will provide the stiffness desired at the rear of the shade 80, while capturing the draw cords 104. Accordingly, rearwardly-extending loop 134 is shown collapsed. Here again, the draw cords 104 ride against the stiffening rods 144 during retraction and extension of the shade 80 to reduce friction between the draw cords 104 and the surrounding structure of the pleats 100.

It will be seen that the shade constructions of the present invention provide an improvement over earlier structures in that the construction facilitates the establishment of aesthetically well-formed folds upon retraction of the shade while assuring positive formation of the folds with uniformity and consistency so that the aesthetic appearance of the shade is more closely controlled by design. The construction enables the accomplishment of a wider variety of aesthetic effects while providing ease of manufacture and enabling aesthetically complex designs to be manufactured more economically. A greater variety of available materials can be used in designs which heretofore did not lend themselves to the ready use of all such materials. Assembly is simplified for increased economy. Installation, operation and use all are simplified and installation and use are permitted in a wider range of locations. The improvement provides a simplified construction which is not only economical to manufacture, but is mechanically sound and rugged enough to extend the usefulness of the shade over a longer service life.

It is to be understood that the above detailed description of preferred embodiments of the invention are provided by way of example only. Various details of design and construction may be modified without departing from the true spirit and scope of the invention, as set forth in the appended claims.

The embodiments of the invention in which an exclusive property or privilege is claimed are defined as follows:

1. In a shade construction of the type in which a vertically hanging sheet of shade material having a prescribed elasticity, a forwardly-facing obverse face and a rearwardly-facing reverse face is provided with a plurality of horizontally-extending, vertically spaced apart pleats, consecutive shade panels delineated by the pleats and extending along a plane coincident wit the hanging sheet, and a draw cord associated with the pleats such that upon drawing the pleats vertically toward one-another to retract the shade material, each shade panel will fold into a forwardly-directed folded configuration, the improvement for facilitating the establishment of an aesthetically well-formed forwardly-directed folded configuration in each of the shade panels upon retraction of the shade material, the improvement comprising:

a rearwardly-extending loop disposed on the rearwardly-facing reverse face of the shade material at each pleat, the loop extending horizontally along the pleat and including a rearwardly-looped portion having a cross-sectional configuration in which the shade material is bent sharply rearwardly to extend in directions generally parallel to the plane of the hanging sheet of shade material so as to enable the elasticity of the material to bias each shade panel toward the forwardly-directed folded configuration, and a pair of legs juxtaposed with one another between the rearwardly-looped portion and the reverse face of the sheet of shade material;

securing means securing the juxtaposed legs together immediately adjacent the reverse face of the sheet of shade material to maintain the legs juxtaposed and the rearwardly-extending loop closed;

a stiffening rod placed within the rearwardly-looped portion and extending horizontally throughout essentially the full horizontal extent of the rearwardly-looped portion; and an aperture in the juxtaposed legs of each rearwardly-extending loop, each aperture being located between the reverse face of the sheet of shade material and the stiffening rod, with corresponding apertures aligned vertically behind the shade material;

the draw cord passing through the aligned apertures.

2. The invention of claim 1 wherein each aperture comprises a slot extending into the rearwardly-looped portion and thence into the juxtaposed legs, the slot having an opening facing rearwardly, and the stiffening rod being located in the rearwardly-looped portion between the opening and the draw cord to capture the draw cord in the slot, between the stiffening rod and the reverse face of the shade material such that upon retraction of the shade, the draw cord will ride against the stiffening rod.

3. The invention of claim 2 wherein the securing means comprises a sewn seam.

4. The invention of claim 1 wherein the sheet of shade material includes transition portions located where each shade panel meets a corresponding pleat and the stiffening rod has a cross-sectional configuration with portions extending in directions parallel to the plane of the sheet of shade material to assure that the shade material is bent sharply rearwardly along the transition portions of the sheet of shade material.

5. The invention of claim 4 wherein the cross-sectional configuration of the rearwardly-looped portion is generally circular and the cross-sectional configuration of the stiffening rod has a complementary generally circular cross-sectional configuration.

6. The invention of claim 1 wherein the securing means comprises a sewn seam.

7. The invention of claim 1 including a forwardly-extending loop disposed on the forwardly-facing obverse face of the shade material at each pleat, the forwardly-extending loop extending horizontally along the pleat and including a forwardly-looped portion having a cross-sectional configuration including portions extending in directions generally parallel to the plane of the hanging sheet of shade material, and a pair of legs, the forwardly-extending loop being related to the rearwardly-extending loop in such juxtaposition that the shade material extends from a shade panel rearwardly into the rearwardly-extending loop and then forwardly from the rearwardly-extending loop into the forwardly-extending loop.

8. The invention of claim 7 wherein the cross-sectional configurations of the rearwardly-looped portion and the forwardly-looped portion are generally circular.

9. The invention of claim 8 wherein the circular configuration of the forwardly-looped portion has a diameter larger than the corresponding diameter of the circular cross-sectional configuration of the rearwardly-looped portion of the rearwardly-extending loop.

10. The invention of claim 9 wherein the securing means comprises a sewn seam.

11. In a shade construction of the type in which a vertically hanging sheet of shade material having a forwardly-facing obverse face and a rearwardly-facing reverse face is provided with a plurality of horizontally-extending, vertically spaced apart pleats, consecutive shade panels delineated by the pleats and extending along a plane coincident with the hanging sheet, and a draw cord associated with the pleats such that upon drawing the pleats vertically toward one-another to retract the shade material, each shade panel will fold into a forwardly-directed folded configuration, the improvement for facilitating the establishment of an aesthetically well-formed forwardly-directed folded configuration in each of the shade panels upon retraction of the shade material, the improvement comprising:

a rearwardly-extending loop in the shade material at each pleat, the loop extending horizontally along the pleat and including a rearwardly-looped portion having a cross-sectional configuration extending in directions generally parallel to the plane of the hanging sheet of shade material, and a pair of legs juxtaposed with one another between the rearwardly-looped portion and the reverse face of the sheet of shade material;

securing means securing the juxtaposed legs together immediately adjacent the reverse face of the sheet of shade material to maintain the legs juxtaposed and the rearwardly-extending loop closed;

a stiffening rod placed within the rearwardly-looped portion and extending horizontally throughout essentially the full horizontal extent of the rearwardly-looped portion;

an aperture in the juxtaposed legs of each rearwardly-extending loop, each aperture being located between the reverse face of the sheet of shade material and the stiffening rod, with corresponding apertures aligned vertically behind the shade material;

the draw cord passing through the aligned apertures;

a forwardly-extending loop in the shade material at each pleat, the forwardly-extending loop extending horizontally along the pleat and including a forwardly-looped portion having a cross-sectional configuration including portions extending in directions generally parallel to the plane of the hanging sheet of shade material, and a pair of legs, the forwardly-extending loop being related to the rearwardly-extending loop such that the shade material extends from a shade panel rearwardly into the rearwardly-extending loop and then forwardly from the rearwardly-extending loop into the forwardly-extending loop; and a second rearwardly-extending loop in the shade material at each pleat, the second rearwardly-extending loop extending horizontally along the pleat and including a further rearwardly-looped portion and a pair of further legs juxtaposed with one another between the further rearwardly-looped portion and the reverse face of the sheet of shade material, the second rearwardly-extending loop being juxtaposed with the first said rearwardly-extending loop and the sheet of shade material including first and second transition portions such that the shade material extends from a shade panel rearwardly through the first transition portion into the first rearwardly-extending loop, then forwardly from the first rearwardly-extending loop into the forwardly-extending loop, then rearwardly from the forwardly-extending loop into the second rearwardly-extending loop, and then forwardly through the second transition portion to the next consecutive shade panel delineated by the pleats, whereby the shade material is bent sharply rearwardly along the first and second transition portions of the shade material, at the locations where each shade panel meets a corresponding pleat, and the securing means secures together the legs of the first said rearwardly-extending loop and the further legs of the second rearwardly-extending loop.

12. The invention of claim 11 wherein each aperture comprises a slot extending into the rearwardly-looped portions of the rearwardly-extending loops and thence into the juxtaposed legs of the rearwardly-extending loops, the slot having an opening facing rearwardly for the reception of the draw cord into the slot, and the stiffening rod being located in at least one of the rearwardly-looped potions between the opening and the draw cord to capture the draw cord in the slot between the stiffening rod and the reverse face of the shade material.

13. The invention of claim 11 wherein the securing means comprises a sewn seam.

14. The invention of claim 11 including a shaping member placed within the forwardly-extending loop and extending horizontally throughout essentially the full horizontal extent of the forwardly-extending loop.

15. The invention of claim 14 wherein the shade material is at least partially transparent and the shaping member is transparent.

16. The invention of claim 15 wherein the shaping member is a transparent tube.

17. The invention of claim 16 wherein the cross-sectional configurations of the rearwardly-looped portion and the forwardly-looped portion are generally circular.

18. The invention of claim 17 wherein the circular configuration of the forwardly-looped portion has a diameter larger than the corresponding diameter of the circular cross-sectional configuration of the rearwardly-looped portion of the first rearwardly-extending loop.

* * * * *